United States Patent [19]

Hater et al.

[11] 4,128,414

[45] Dec. 5, 1978

[54] METHOD OF INTRODUCING ALUMINUM WIRE INTO STEEL MELTS AND APPARATUS FOR PRACTICING SAID METHOD

[75] Inventors: Martin Hater; Wolfgang Pluschkell; Heinrich Wisnewski, all of Dortmund, Fed. Rep. of Germany

[73] Assignee: Hoesch Werke Aktiengesellschaft, Dortmund, Fed. Rep. of Germany

[21] Appl. No.: 747,438

[22] Filed: Dec. 6, 1976

[30] Foreign Application Priority Data

Dec. 5, 1975 [DE] Fed. Rep. of Germany ..... 2554860

[51] Int. Cl.[2] ..... C21C 7/00

[52] U.S. Cl. ..... 75/58; 75/53; 75/129

[58] Field of Search ..... 75/53, 58, 129, 61

[56] References Cited

U.S. PATENT DOCUMENTS

| | | | |
|---|---|---|---|
| 3,728,109 | 4/1973 | Okubo | 75/51 |
| 3,729,309 | 4/1973 | Kawawa | 75/129 |
| 3,871,871 | 3/1975 | Nemoto | 75/53 |

*Primary Examiner*—Peter D. Rosenberg
*Attorney, Agent, or Firm*—Walter Becker

[57] ABSTRACT

A method of introducing aluminum wire into steel melts, and apparatus for practicing the method, according to which the wire is by means of a set of driving rollers withdrawn overhead from a bundle at rest and through a guiding member is introduced into the melt.

1 Claim, 3 Drawing Figures

METHOD OF INTRODUCING ALUMINUM WIRE INTO STEEL MELTS AND APPARATUS FOR PRACTICING SAID METHOD

The present invention relates to a method of introducing aluminum wire into steel melts while the wire is withdrawn from a bundle by means of a set of driving rollers and is through guiding means introduced into the melt. In this connection, the wire was heretofore withdrawn from a roller or a reel as disclosed for instance in Austrian Pat. No. 241,036. This way of introducing aluminum wire into steel melts, has drawbacks in various respects. Thus, the roller from which the wire is withdrawn has to be rotated in conformity with the specific speed of introduction of the wire has to be accelerated and has to be held at the respective speed and also has to be braked to a standstill. With the synchronization of the speed of rotation of the wire roller (from which, at any rate with larger roller weights, a special device has to be provided) to the feeding speed of the driving roller set, considerable control problems are involved. Nevertheless, a retarded running up to the feeding speed and a retarded braking to the standstill has to be put up with. The synchronism, which is particularly important with small feeding quantities is also lacking over the entire treatment period. Inasmuch as the rotating masses must not be too high, the delivery quantity available is limited and the weights of the melt to be treated have to be adjusted accordingly.

It is an object of the present invention so to design the introduction of aluminum wire into steel melts that in particular the above outlined drawbacks will be avoided.

This object and other objects and advantages of the invention will appear more clearly from the following specification in connection with the accompanying drawings, in which.

Figure 1:
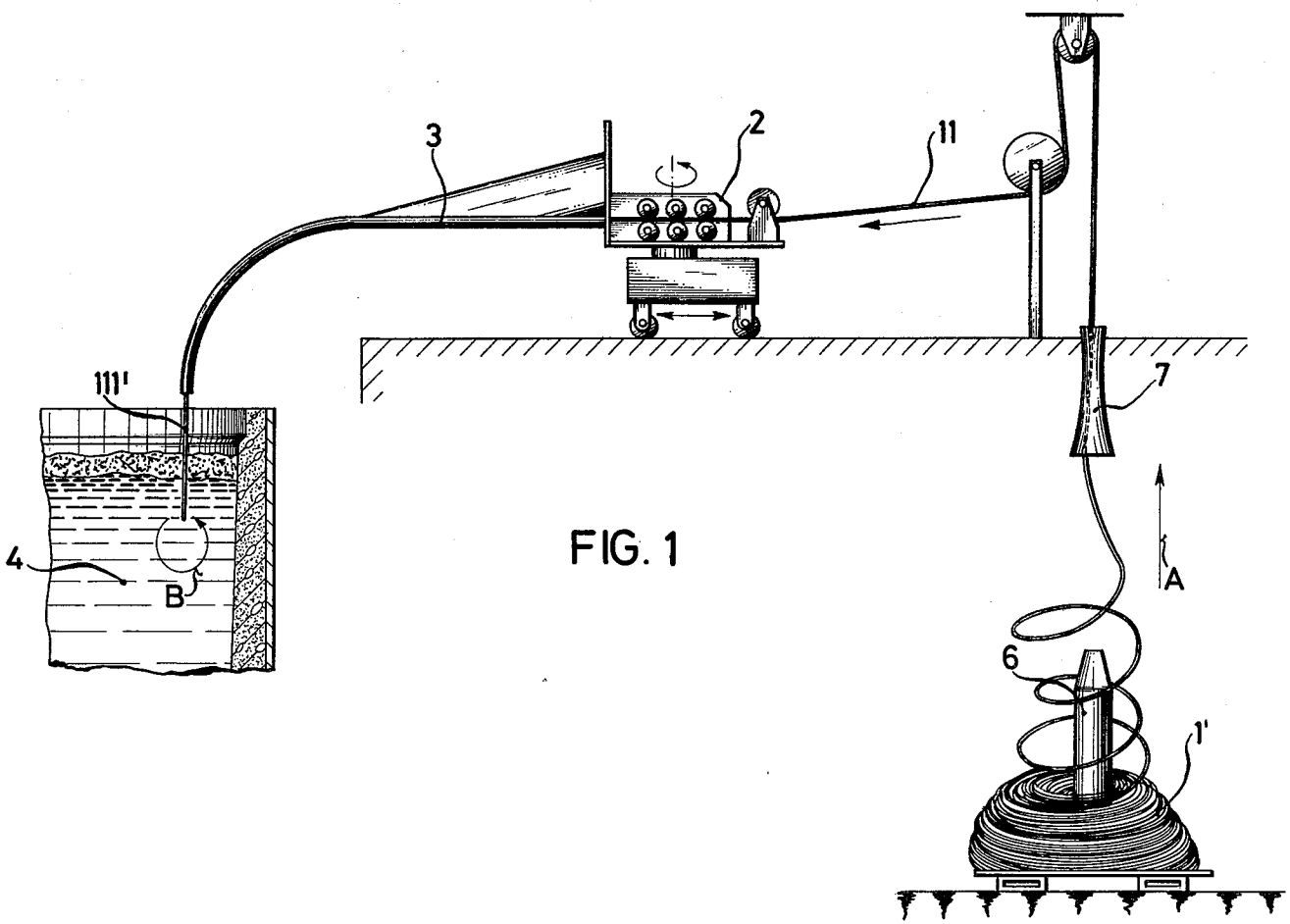
FIG. 1 shows a plant for carrying out the method according to the invention.

The method according to the present invention is characterized primarily in that when introducing the aluminum wire into steel melt while the wire is being drawn from a bundle by means of a set of driving rollers and is introduced into the melt through guiding means, the wire is withdrawn overhead from a bundle at rest. Thus, the requirement is eliminated to also move the wire supply during the feeding operation. This results in the desired wire synchronous movement over the entire feeding period. Thus also any limitation as to the storing is eliminated. The synchronous movement of the wire or the constant feeding quantity over the entire treatment period assures the optimum treatment effect. The withdrawal of the wire from the bundle at rest makes unnecessary expensive control and control technical installations.

A further advantage of the method according to the invention consists in the possibility of starting with wire of greater diameter, especially when employing loose bundles. The properties resulting therefrom such as a higher weight per meter and greater wire stiffness will assure a better removal and greater immersion depth and thus will also assure a more intensive treatment with smaller quantities.

Higher meter weight of the wire and loose wire bundle will reduce the cost of material. Particularly if, as is also possible the operation starts with a wire roll or coil, with this method the additional advantage is realized that the wire withdrawn overhead will also after passing through the set of driving rollers have the tendency to carry out an agitating movement of the wire end at the immersion side which movement aids in an intensive treatment of the melt.

Particularly when employing loose wire bundles as supply, the method according to the invention makes possible the uninterrupted holding in readiness by connecting the rear end of the bundle being employed with the leading end of a further bundle kept in readiness. In this way, a continuous employment of the method is possible independently of the cut-off weights or filling weights of the treatment container. The fully continuous operation is of particular interest when employing the method according to the invention in connection with continuous casting. The arrangement for practicing the method is governed by the method instruction, which means to arrange the loose bundle or the wire roll or reel on a mandrel which extends in front of the set of driving rollers and preferably is aligned with the withdrawal direction. The installation of two mandrels spaced from each other laterally permits the continuous withdrawal.

Referring now to the drawings in detail, the wire 11 is withdrawn in the direction of the arrow A from the resting bundle 1 (FIGS. 1 and 2) or from the resting coil 1'' (FIG. 3) by means of the set of driving rollers and is passed through the guiding pipe 3 into the steel melt 4.

Mandrels 6 are employed for fixing the bundle 1 or coil 1''. Two mandrels 6, 6' (FIG. 2) which are arranged adjacent to each other in spaced relationship to each other permit a continuous operation by connecting the rear end 111 of the bundle 1 being employed with the leading end 111' of the bundle 1' still held in readiness.

Figure 2:
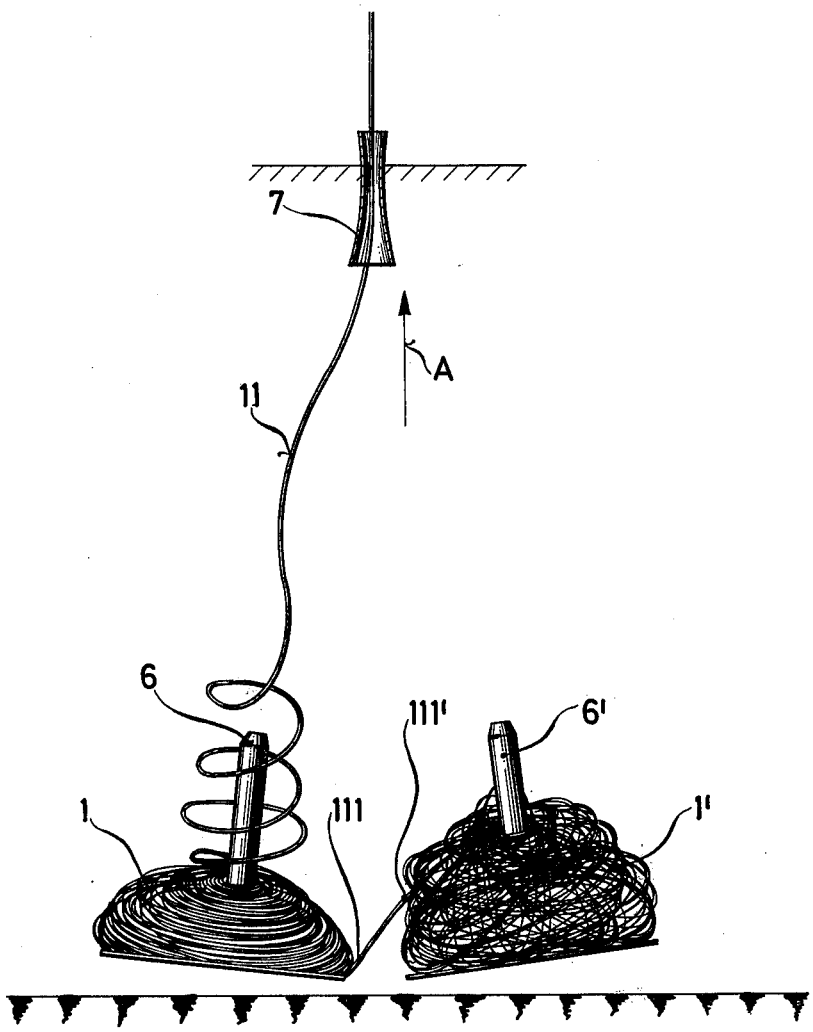
FIG. 2 illustrates a modification of the plant of FIG. 1.
Figure 3:
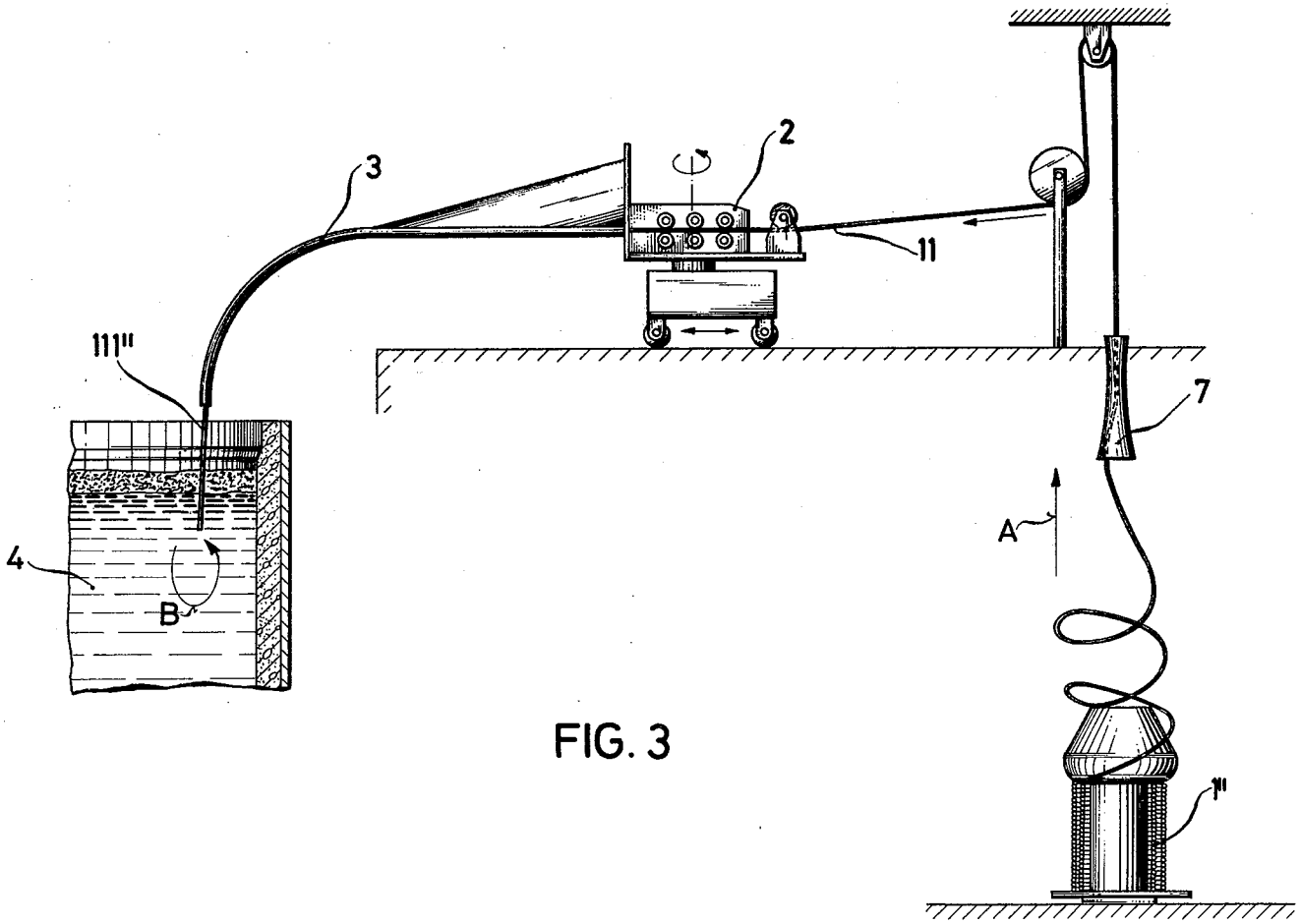
FIG. 3 shows the plant of FIG. 1 with a coil as wire supply instead of a wire bundle.

The reference numeral 7 designates a curl quieting section provided between the wire supply 1, 1' and the set of driving rollers 2. From the possibility of starting with greater wire thicknesses, especially when withdrawing the wire from the coil 1'', there results the tendency of the wire end 111'' at the immersion side to carry out an agitating movement as indicated by the arrow B (FIGS. 1 and 3).

It is, of course, to be understood that the present invention is, by no means, limited to the specific showing in the drawing, but also comprises any modifications with the scope of the appended claims.

What We Claim Is:

1. A method of introducing aluminium wire into a steel melt in a fully continuous operation, which includes in combination the steps of:

withdrawing the wire overhead from a stationary wire bundle at rest, and feeding the withdrawn wire into the melt while guiding the withdrawn wire with rollers engaging wire free from play prior to its introduction with synchronous movement to assure constant feeding quality for optimum treatment effect into the melt over the entire feeding period.

* * * * *